United States Patent [19]

Gustafsson

[11] Patent Number: 4,619,334

[45] Date of Patent: Oct. 28, 1986

[54] JOINT DEVICE IN EXTENSION DRILL EQUIPMENT FOR PERCUSSIVE DRILLING

[75] Inventor: Christer Gustafsson, Norberg, Sweden

[73] Assignee: Secoroc AB, Fagersta, Sweden

[21] Appl. No.: 770,165

[22] Filed: Aug. 28, 1985

[30] Foreign Application Priority Data

Sep. 6, 1984 [SE] Sweden ..... 8404488

[51] Int. Cl.[4] ..... E21B 17/07

[52] U.S. Cl. ..... 175/321; 175/414; 285/140; 267/137

[58] Field of Search ..... 175/320, 321, 322, 414, 175/415; 285/140; 403/292; 267/125, 137

[56] References Cited

U.S. PATENT DOCUMENTS

| | | | |
|---|---|---|---|
| 3,257,827 | 6/1966 | Hughes | 175/320 |
| 3,592,276 | 7/1971 | Pyles | 175/414 |
| 3,853,188 | 12/1974 | Vasiliev et al. | 175/321 |
| 3,947,008 | 3/1976 | Mullins | 267/137 |
| 4,428,443 | 1/1984 | Oliphant | 267/137 |
| 4,466,496 | 8/1984 | Jones | 175/321 |

FOREIGN PATENT DOCUMENTS

| | | | |
|---|---|---|---|
| 0837970 | 3/1970 | Canada | 175/321 |
| 2100504 | 9/1971 | Fed. Rep. of Germany | 175/321 |
| 0608909 | 5/1978 | U.S.S.R. | 267/137 |
| 0629313 | 10/1978 | U.S.S.R. | 267/125 |
| 0697683 | 11/1979 | U.S.S.R. | 175/321 |
| 0842189 | 6/1981 | U.S.S.R. | 175/320 |

*Primary Examiner*—James A. Leppink
*Assistant Examiner*—Terry Lee Melius
*Attorney, Agent, or Firm*—Pollock, VandeSande and Priddy

[57] ABSTRACT

A joint device in extension drill equipment for percussive drilling is so constructed that, besides transmitting compressive pulses in the drill string in the direction towards the drill bit, it also by reflection transforms tensile pulses in the drill string into compressive pulses. Preferably, the joint device includes members that are axially movable relative to each other and provided with interacting surfaces, and an element connecting the members. Compressive pulses cause these surfaces to abut each other under pressure, while tensile pulses cause the surfaces to become separated. Also preferably, the joint device includes a structure for absorbing kinetic energy generated in the device by torsion pulses in the drill string.

11 Claims, 15 Drawing Figures

Figure 1:
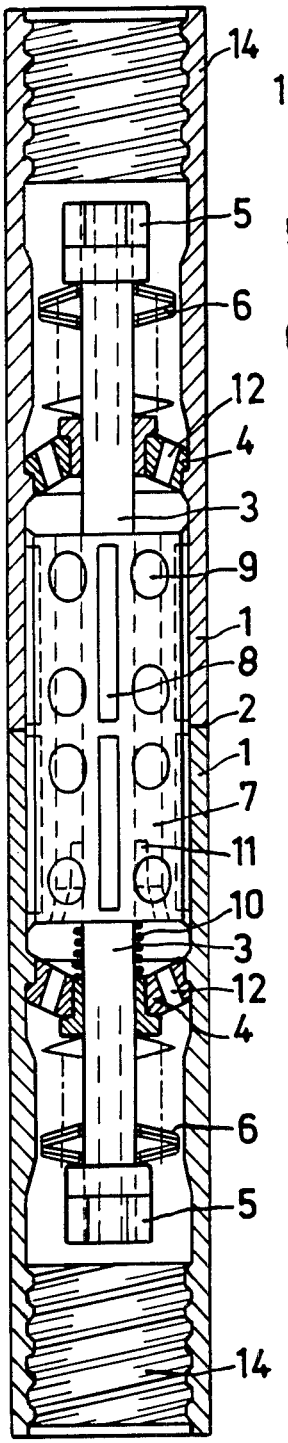

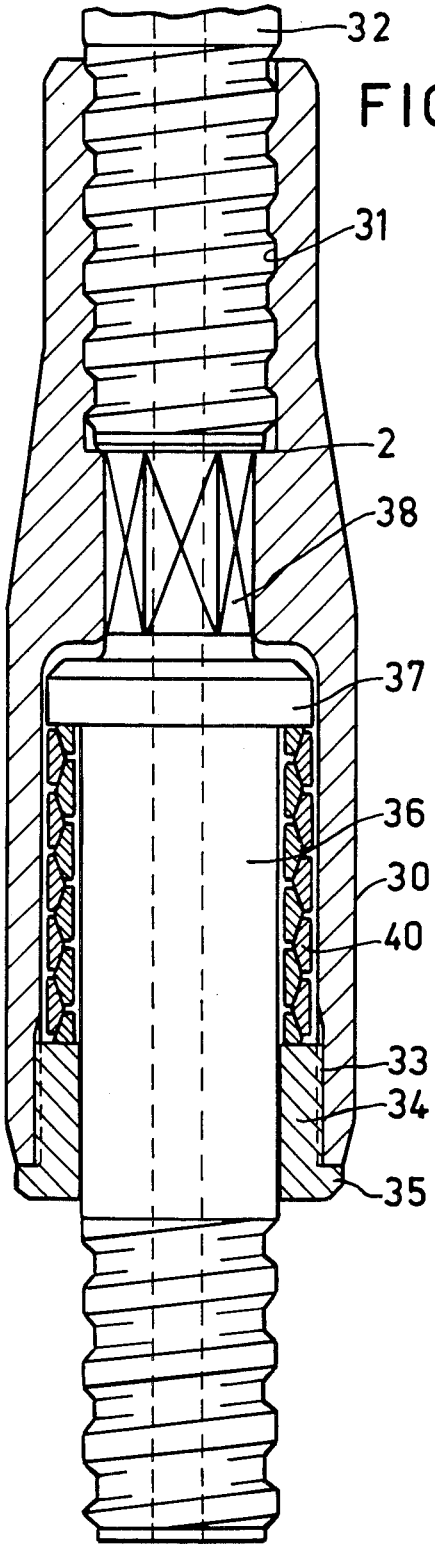
FIG.13
FIG.14
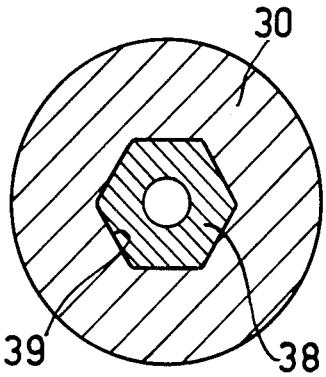

JOINT DEVICE IN EXTENSION DRILL EQUIPMENT FOR PERCUSSIVE DRILLING

The present invention relates to a joint device in extension drill equipment for percussive drilling (hammer drilling) that is arranged in the drill string between drill machine and drill bit.

Percussive drilling, for instance in rock, always generates compressive and tensile stresses in the tubes or rods used for transmitting impact energy and torque to the drill bit. The compressive and tensile stresses move to and fro in the drill string in the form of pulses. These compressive and tensile stresses often consist of reflected pulses, since they are generated by reflection in the joint devices joining the tubes or rods in the drill string and connecting the drill string to the drill bit. Large tensile stresses which are reflected back in the form of tensile pulses are above all generated at the drill bit. At the bit the phenomenon can in principle be described in such a way, that when the compressive pulse primarily generated at the drill machine reaches the bit, a part of the compressive pulse will always be reflected back through the drill string as a tensile pulse; the more incomplete the rock crushing is, the larger becomes the tensile pulse. In for instance an idling blow, i.e. a blow not doing any work which occurs when the bit meets cracks or cavities in the rock, the whole compressive pulse will be reflected back as an equally large tensile pulse.

In all joint devices known up to now, for instance the most common joint devices which for practical reasons, for instance for facilitating the disassembling of the extension drill equipment, are provided with threads for the joint of the members (tubes or rods and drill bit) included in the extension drill equipment, the pulses are transmitted through the joint devices more or less unimpededly. Pulses, compressive pulses and reflected tensile pulses, obtained by a blow from the drill machine accordingly move more or less unimpededly to an fro a number of times through the drill string and are gradually damped out by the inherent damping of the material and the friction of the drill string against the drilled hole wall. This is repeated over and over again between each blow from the drill machine, and with the existing high frequencies resulting from blows (usually 30–40 Hz but 150 Hz can exist) the drill string will accordingly in a short time be subjected to many fatigue cycles.

These pulses moving to and fro in the drill string cause wear and fractures in the string and particularly the tensile pulses can cause very premature fatigue fractures.

Any means to overcome the above mentioned problems in connection with the pulses travelling in the drill string during percussive drilling has up to now not been presented. For rotary drilling, however, joint devices are known which are particularly constructed for eliminating vibrations, i.e. pipe dampers, see for instance No. FR-A1-2 432 081, No. NO-B-146 550 and U.S. Pat. No. 3,608,297. These joint devices are, however, inapplicable for percussive drilling since, in such an application, they would absorb a great part of the primary impact energy as well as the reflected pulses, which results in a quite unacceptable efficiency in connection with percussive drilling, and furthermore the joint devices would wear rapidly due, among other things, to the generating of friction heat.

The present invention, however, provides joint devices in extension drill equipment for percussive drilling, in which the above mentioned problems have been solved, and the invention is characterized in that the joint device is provided with means which, besides transmitting compressive pulses in the drill string in the direction towards the drill bit, also by reflection transforms tensile pulses in the drill string directed opposite to the compressive pulses into compressive pulses.

Thus, by a joint device according to the invention detrimental tensile pulses are transformed into useful compressive pulses. In other words, the joint device according to the invention has been given a configuration such that useful energy (compressive pulses) passes through and unuseful energy (tensile pulses) is transformed into useful energy. This results in an improved efficiency compared with the efficiency obtained when using previously known joint devices. Moreover, the transformation of tensile pulses into compressive pulses increases the life of the drill string considerably since the total level of the detrimental tensile stresses in the drill string is considerably lowered.

In a preferred embodiment the joint device according to the invention is characterized in that said means consists of an element, which holds together members axially movable relative each other, and of cooperating impact surfaces of the members, which surfaces upon compressive pulses abut each other under pressure and upon tensile pulses are separated. Preferably, said members are concentrically in line with the drill string. This can be realized in several advantageous embodiments.

In addition to said reciprocating compressive and tensile pulses, shear stresses also exist in a drill string. These exist in the form of stresses caused by torque transmitted to the drill bit as well as superposed torsion pulses caused among other things by the rotation of the drill bit against the rock. The torsion pulses are to their nature a dynamic stress in the form of shear stresses which in each moment can be added to compressive and tensile pulses and accordingly also contribute to a fatigue of the drill string. In a preferred embodiment of a joint device according to the invention consideration has also been given to elimination these torsion pulses by providing means in the joint device for absorbing kinetic energy originating from torsion pulses in the drill string in the joint device.

Some embodiments of joint devices according to the invention are in the following described more in detail with reference to the accompanying drawings, wherein FIG. 1, FIG. 2, FIG. 3, FIG. 7, FIG. 9, FIG. 10 and FIG. 13 show axial sections through different embodiments of a joint device according to the invention and FIG. 4, FIG. 5, FIG. 6, FIG. 8, FIG. 11, FIG. 12 and FIG. 14 show cross sections through the joint device according to FIG. 1, FIG. 2, FIG. 3, FIG. 7, FIG. 9, FIG. 10 and FIG. 13, respectively. FIG. 3*a* shows a side view of a moment transmitting element incorporated in the embodiment according to FIG. 3.

Corresponding details in the different drawings have been designated with the same reference numerals.

As described above, the essential thing about the present invention is to provide a joint device which besides the transmission of compressive pulses in the drill string in direction towards the drill bit also by reflection converts tensile pulses in the drill string directed opposite to the compressive pulses into compressive pulses, and the drawings illustrate some examples more in detail how this can be realized.

The joint devices illustrated in FIGS. 1–8 all include two tubular parts or members 1 provided at their outer ends with an internal thread 14 for the connection to the drill string. Opposite tube ends abut each other along impact surfaces 2. The tubes 1 are axially held together via the impact surfaces 2 by means of a tension rod 3 and washers 4. A spring built up by, for instance, spring washers 6 is arranged between nuts 5 at the ends of the draw rod and the washers 4. The tubes 1 can abut each other without prestressing or, by tightening of the nuts 5, an adjustable axial prestressing can be obtained. The joint devices furthermore include an axially movable moment-transmitting element 7 which is described hereinafter in greater detail.

For transmitting compressive pulses and converting tensile pulses into compressive pulses the joint devices operate in the following way.

When a tensile pulse enters the joint devices, for instance from the drill bit, and travels towards the impact surfaces 2, the tensile pulse will comprehend the draw rod 3 and the axially movable moment transmitting element 7 as a small dynamic resistance. The tubes 1 separate at the impact surfaces 2 under the influence of the tensile pulse. Thus, the tensile pulse will comprehend the separated impact surface 2 as a free surface and will accordingly be converted into a compressive pulse which is reflected back approximately in the same manner as occurs upon the above described free impact of the drill bit when a compressive pulse is converted into a tensile pulse. When, on the other hand, a compressive pulse travels against the impact surfaces 2, the surfaces are pressed against each other and the compressive pulse can pass without being changed, which is important since the primary pulse from the drill machine is a compressive pulse and an indispensable demand for a joint device for transport of impact energy is that the compressive pulse shall pass unimpededly.

Thus, the tensile pulse is hindered from passing through the joint device and propagating in the drill string. Stresses in the drill string decrease considerably as a result and, at the same time, the efficiency of the percussive drilling increases due to the conversion of a non-desired tensile pulse into a useful compressive pulse.

Figure 9:
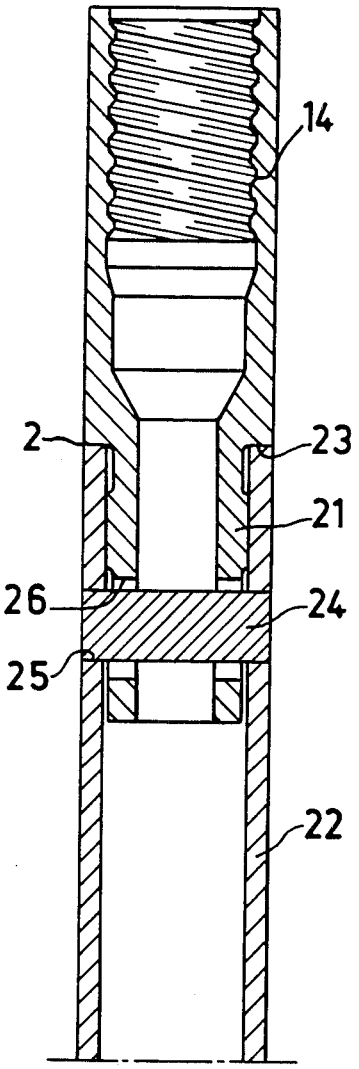
Figure 10:
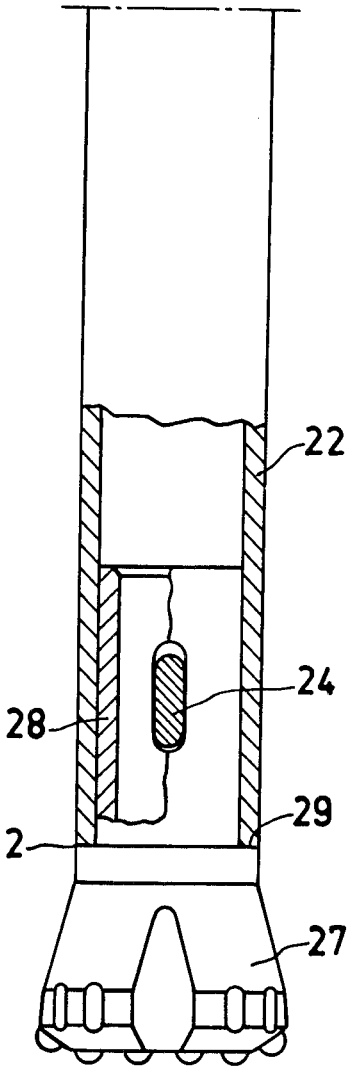
Figure 11:
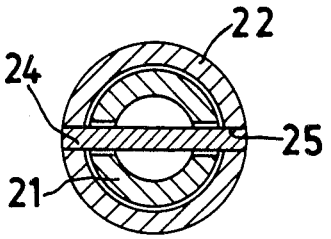

FIGS. 9–12 illustrate some other embodiments of joint devices for transmitting compressive pulses and converting tensile pulses into compressive pulses. In FIGS. 9 and 11 the joint device is shown positioned along the drill string and in FIGS. 10 and 12 the joint device is shown connected to the drill bit.

In the embodiment shown in FIGS. 9 and 11 the joint device is in one end provided with a thread 14 corresponding to the thread 14 in the previously described embodiments, while the opposite end portion 21 is formed for fitting into the drill string tube 22. The end surface of the tube 22 abuts a shoulder 23 in the joint device, and the end surface and the shoulder form impact surfaces corresponding to the impact surfaces 2 in the previously described embodiments. A transverse wedge 24 is fixed in complementary grooves 25 in the tube 22 but is arranged with play in grooves 26 made in the end portion 21.

Figure 12:
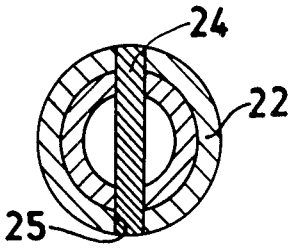

In the embodiment according to FIGS. 10 and 12 a corresponding wedge 24 is fixed in grooves 25 in a drill string tube 22 and arranged with play in grooves 26 in a shirt 28 of a drill bit 27. Impact surfaces 2 are formed between the end surface of the tube 22 and the shoulder 29 of the bit.

As distinguished from the rod 3 in the embodiments of FIGS. 1–8, the combining element consists of the wedge 24 in the embodiments shown in FIGS. 9–12. The embodiments according to FIGS. 9–12 are in construction simpler than the embodiments according to FIGS. 1–8; however they are in from a dynamic point of view somewhat inferior due to the fact that a part of the primary compressive pulse from the drill machine will be reflected back because of the different cross section areas between the members 21 and 22 in FIG. 9 and the members 22 and 27 in FIG. 10. Tensile pulses are however converted as effectively as in the embodiments according to FIGS. 1–8 by the fact that the impact surfaces are separated for tensile pulses.

Although not shown, for instance an embodiment having several wedges is possible as well as wedges in combination with a rod in accordance with FIGS. 1–8, wherein however springs corresponding to the springs 6 are omitted or a spring is arranged at only one end of the rod.

Besides transporting impact energy from a drill machine to a drill bit, a joint device must also be configurated to transmit torsional forces.

In the embodiments according to FIGS. 1–8 the transmission of torque between the tubes 1 takes place by means of the moment-transmitting element 7 and wedges or balls. In the embodiment according to FIGS. 1 and 4 longitudinal wedges 8 are arranged in wedge grooves that are provided in the moment-transmitting element 7 and the tubes 1. In the embodiment according to FIGS. 2 and 5 the wedges 8 are replaced by resilient rods or wedges 15. The embodiment according to FIGS. 3 and 6 has as shown wedges corresponding to the wedges 8 in FIGS. 1 and 3. In the embodiment according to FIGS. 7 and 8 wedges 8 are replaced by transverse wedges 20. In the embodiments according to FIGS. 9–12 the wedge 24 connecting the members 21, 22 and 22, 27, respectively, also constitutes torque transmitting means.

As mentioned above, not only axial compressive and tensile pulses are generated in the drill string but also torsion pulses can be generated which are added to the axial pulses and accordingly contribute to the fatigue of the drill string. Joint devices according to the invention can for that reason in preferred embodiments be completed or provided with means for eliminating completely or partly also these torsion pulses.

Figure 3:
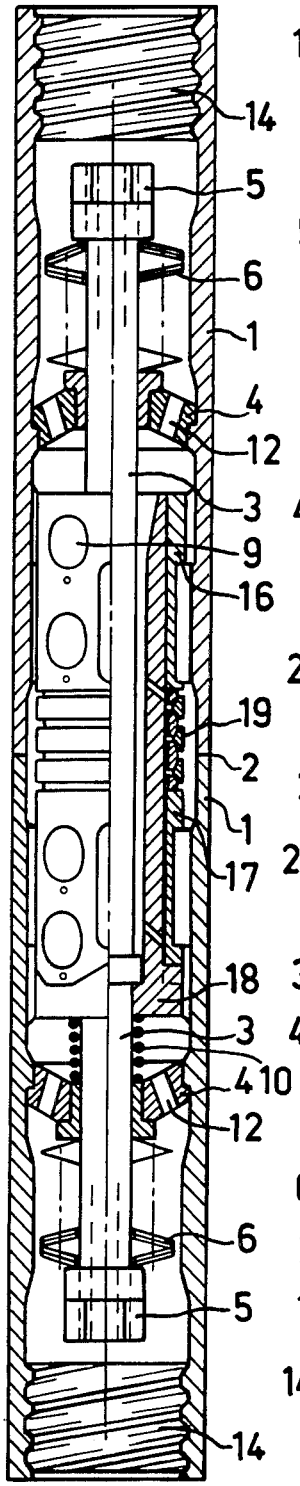
Figure 7:
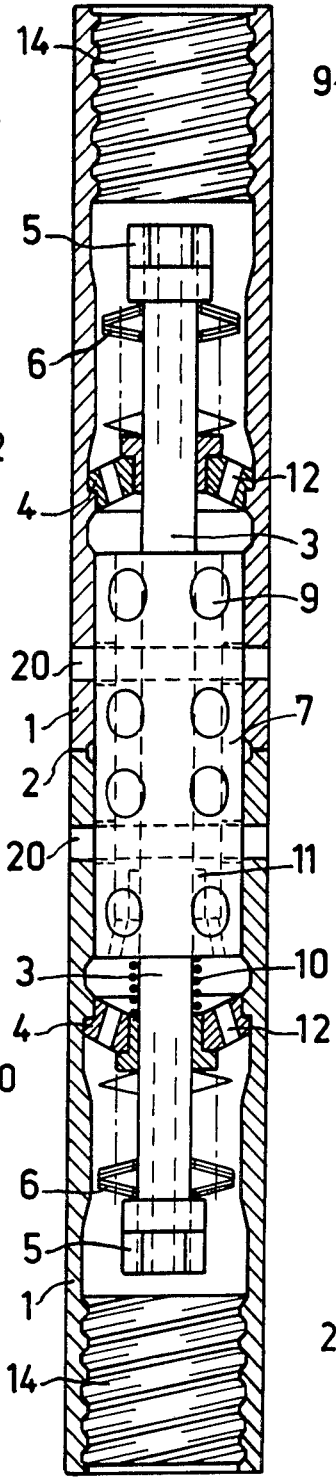
Figure 6:
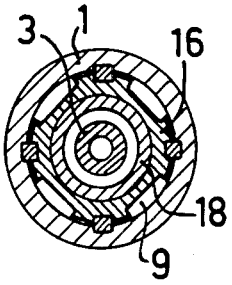
Figure 8:
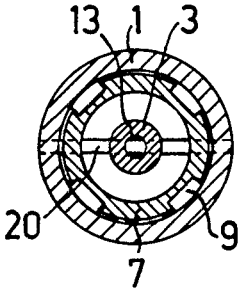

FIGS. 3 and 6 show such a completed embodiment. The moment transmitting element 7 is here composed of two parts or members 16 and 17 that are connected by a sleeve 18 which is fixed to the member 16 and runs inside of the member 17. The sleeve 18 is in one end fixed to a device which on surface abutting the member 17 is formed with a cam profile fitting in a corresponding profile in the member 17. Subject to torsion pulse and torque the members 16 and 17 will be twisted relative each other, wherein the membe 17 is forced to follow the cam curve and is then pressed against the member 16. This yields a compression of a spring pack 19 and absorbtion of the kinetic energy generated by the torsional pulses. The moment-transmitting element 7 is separately shown in side view in FIG. 3*a*.

Figure 2:
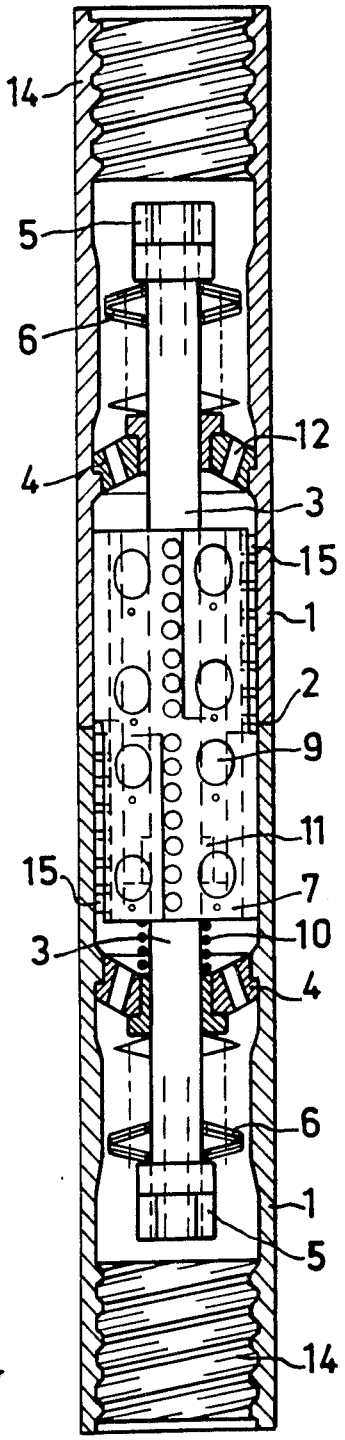
Figure 4:
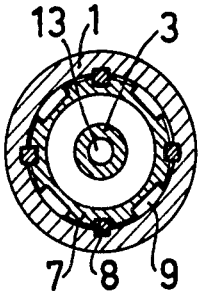
Figure 5:
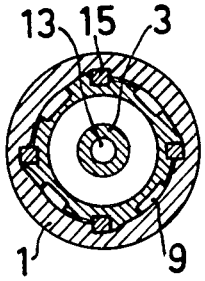
Figure 3A:
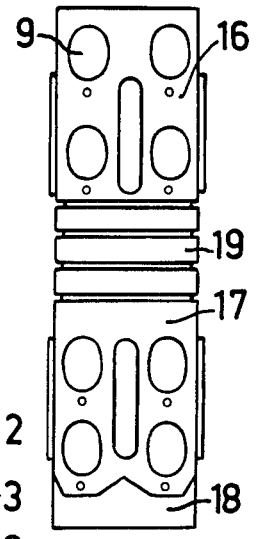

In the embodiment according to FIGS. 2 and 5, the resilient rods or wedges 15 achieve a certain elimination of torsion pulses.

Although not shown, the other embodiments can of course also be provided with for instance some type of spring device for absorbing kinetic energy generated by torsional pulses.

Moreover, FIGS. 1–8 show that the moment transmitting element 7 is provided with pins or washers 9 of steel, antifriction metal or polymer, which prevent burning between the moment-transmitting element 7 and the tubes 1. The moment-transmitting element 7 is actually movable and this movement is guided by springs 10 and a collar 11 on the rod 3. The rod 3 yields in operation by the passage of the compressive pulse an impact force to the moment transmitting element 7 in the direction towards the drill bit resulting in an oscillating axial movement of the moment-transmitting element which together with the pins or washers 9 prevents local heating. Owing to this oscillating movement of the moment-transmitting element 7, a supporting lubricating film can also be maintained between the wedges 8, the pins 9 and the tubes 1. The impact force to the moment-transmitting element 7 is obtained by shunting a portion of the compressive stress from the drill machine via the washers 4 to the rod 3 which via its collar 11 hits the moment-transmitting element 7. FIGS. 1–8 furthermore show that the rod 3 and the washers 4 are provided with flushing channels 12 and 13, respectively, for free passage of flushing medium, for instance air. Between the inner surface of the tubes 1 and element 7 is a gap in which the flushing medium can pass for cooling the moment transmitting element 7, the wedges 8 and the tubes 1.

Above has been described some embodiments of joint devices according to the invention having internal connecting element in the form of a rod 3 or wedge 24 for the members 1 and 21, 22 and 22, 27, respectively, movable axially relatively each other. A connecting element, however, can also be externally positioned and in FIGS. 13 and 14 such an embodiment is by way of example illustrated. The element here consists of an external sleeve 30 provided with an upper internal thread 31 in engagement with a drill string rod 32 and provided with a lower internal thread 33 in engagement with a nut-like element 34 having a flange 35 against which the lower end surface of the sleeve 30 abuts. The nut 34 is thread on a rod 36 provided with collar 37 and having an extension 38 with for instance a hexagonal cross section, which is fitted into the sleeve 30 in a hole 39 of corresponding cross section. The rod 36 can for instance be connected to a drill bit. A spring element 40 positioned between the nut 34 and the collar 37 is arranged in the space between the sleeve 30 and the rod 36, and the spring element can by the nut be prestressed. The end surface of the drill string rod 32 and the end surface of the extension 38 form impact surfaces corresponding to the impact surfaces 2 in the previously described embodiments. The extension 38 is also a torque-transmitting means corresponding to the moment-transmitting element 7 and the wedges 24 in the previously described embodiments.

The invention should not be limited in its scope or spirit to the embodiments described above and shown on the drawings but can be realized in several other embodiments within the frame of the following claims.

I claim:

1. Joint device in extension drill equipment for percussive drilling and arranged in the drill string between a drill machine and a drill bit, said joint device having a pair of interacting impact surfaces therein, and means cooperating with said impact surfaces for transmitting compressive pulses in the drill string above said impact surfaces in the direction towards the drill bit, said means also being operative by reflection to transform tensile pulses that are present in the drill string below said impact surfaces, and directed opposite to said compressive pulses, into further compressive pulses.

2. A joint device according to claim 1, including means for absorbing kinetic energy generated in the joint device by torsion pulses in the drill string.

3. A joint device according to claim 2, including two members turnable relative to each other, and a resilient element for absorbing the kinetic energy generated upon the relative turning of the members.

4. A joint device according to claim 1 wherein said means consists of at least one element that connects a pair of members which are movable axially relative to each other, said interacting impact surfaces being provided on said members respectively, said element being operative in response to compressive pulses to cause said impact surfaces to abut each other and being operative in response to tensile pulses to cause said impact surfaces to become separated.

5. A joint device according to claim 4, wherein said element consists of a tension rod positioned axially within the drill string.

6. A joint device according to claim 4, wherein said element consists of at least one wedge positioned laterally relative to the drill string, said wedge being fixed to one of said members and axially movable in the drill string direction relative to the other of the members.

7. A joint device according to claim 4, wherein said element consists of a sleeve positioned externally of said members.

8. A joint device according to claim 4, including means for transmitting torque between said members.

9. A joint device according to claim 4, wherein said members are concentrically in alignment with the drill string.

10. A joint device according to claim 4 or 9, wherein said element connects said members with a prestressed abutment pressure between said impact surfaces.

11. A joint device according to claim 10, including means for adjustment of said prestressed abutment pressure.

* * * * *